United States Patent [19]

Nagai

[11] Patent Number: 4,915,604

[45] Date of Patent: Apr. 10, 1990

[54] ROTORS FOR A SCREW FLUID MACHINE

[75] Inventor: Toshiaki Nagai, Shimizu, Japan

[73] Assignee: Hitachi, Ltd., Tokyo, Japan

[21] Appl. No.: 228,422

[22] Filed: Aug. 5, 1988

[30] Foreign Application Priority Data

Aug. 11, 1987 [JP] Japan ..... 62-199119

[51] Int. Cl.[4] ..... F01C 1/16

[52] U.S. Cl. ..... 418/201; 74/462

[58] Field of Search ..... 74/458, 462; 418/201 B, 418/206

[56] References Cited

U.S. PATENT DOCUMENTS 3,902,827 9/1975 Schibbye ..... 418/201 R X
3,946,620 3/1976 Yamamoto et al. ..... 74/462
4,475,878 10/1984 Kasuya et al. ..... 418/201 B
4,492,546 1/1985 Kasuya et al. ..... 418/201 B

FOREIGN PATENT DOCUMENTS 2413708 10/1975 Fed. Rep. of Germany ... 418/201 B

*Primary Examiner*—Michael Koczo
*Attorney, Agent, or Firm*—Antonelli, Terry & Wands

[57] ABSTRACT

A screw fluid machine comprising female and male rotors each including foward and backward flanks each having a reference profile, respectively, wherein on at least one of the forward and backward flanks of the female and male rotors a modified profile is obtained by appropriately angularly shifting the reference profile around a center of the associated rotor to provide proper backlash between the engaged rotors.

4 Claims, 6 Drawing Sheets

ROTORS FOR A SCREW FLUID MACHINE

BACKGROUND OF THE INVENTION

The present invention relates to a screw fluid machine used for air compressors, refrigerators, air conditioners or the like, and more particularly, to a screw fluid machine having a specific rotor profile, wherein a pair of male and female rotors meshed with each other can rotate in a casing and which is suitable, for example, for oil-cooled screw fluid machines such as compressors for supplying oil to a compression space.

A rotor profile is proposed in, for example, Japanese Patent Laid-Open 59-29794, for an oil-cooled screw compressor of the type wherein a male rotor and a female rotor are meshed with each other and one of these rotors drives the other rotor through the direct contact engagement therebetween.

In this conventional fluid machine, a portion of the profile of the driving rotor, which contacts the driven rotor, is limited to one situated around a position where load acting on the contact portions or faces between the rotors is minimized, and the remaining portion of the profile of the driving rotor is maintained so as not to contact the driven rotor by a gap therebetween. Thus, no consideration was given to the fact that the gap was increased in the remaining portion of the profile, since only very limited portions of the rotors meshed with each other.

The profiles of the rotors used in the conventional oil-cooled screw compressor were obtained by merely copying a reference profile with a certain intentionally selected clearance along the entire periphery of the rotors.

In the specification, the reference profile means a profile formed in such a manner that the male and female rotors are meshed with each other without any clearance or gap therebetween.

Thus, in the conventional male and female rotors having the profiles obtained by merely copying the reference profile with a certain clearance along the entire periphery thereof, since motion of a contact point of these rotors deviates from that to be obtained by the fully contacted reference profiles through the revolution, there was uneven or unequal movement of the rotors. Moreover, since there was an unnecessary gap between the rotors, a reduction in efficiency or performance resulted from leakage of compressed air and the like.

As shown in FIG. 3, in a conventional method for providing for rotors, a profile 1 of a male rotor forms a reference profile, with a profile 5 of a female rotor being obtained by copying an essential reference profile thereof with a uniform intentionally selected gap $\delta$ along the entire periphery thereof in a direction of a center 4 of the female rotor or in a radially inner direction. Arrows in FIG. 3 show directions of rotation of the rotors.

In the male and female rotors thus obtained, there arose problems that the even or uniform movement of the rotors was not ensured as explained above, and, since there was the clearance $\delta$ between a bottom 5*b* of the female rotor and a tip 1*a* of the male rotor, the compressed air leaked as explained above, thus decreasing the efficiency or performance of the machine.

SUMMARY OF THE INVENTION

An object of the present invention is to solve the above-mentioned problems in the conventional screw fluid machine such as a screw compressor, and to provide a screw fluid machine wherein a proper gap or clearance is established between male and female rotors meshed with each other to always maintain uniform motions thereof, thus improving efficiency or performance of the machine and decreasing noise and vibration during operation of the machine.

In order to achieve the object above, the present invention provides a screw fluid machine comprising a female rotor having a main portion positioned inside of a pitch circle thereof and including a plurality of recesses and projections formed between these recesses, with each of the recesses having a forward flank. A backward flank, and a male rotor has a main portion positioned outside of a pitch circle thereof, a plurality of projections and recesses formed between these projections, and a contour having a backward flank and a forward flank engaged with the female rotor. The female and male rotors are rotatably supported in a casing, with the male rotor being driven by a driving means, wherein, when tooth shapes of the male and female rotors formed by generation from each other in such a manner that the male and female rotors are meshed with each other without clearance therebetween are defined as reference profiles, a profile of at least one of the forward and backward flanks of the male and female rotors is formed as a modified profile obtained by appropriately angularly shifting or rotationally displacing the reference profile thereof around a center of the associated rotor so as to provide proper backlash between a tooth (teeth) of the rotor and a tooth (teeth) of the other rotor meshed therewith.

Alternatively, the above object can be achieved by providing a screw fluid machine of the above-mentioned type, wherein, when tooth shapes of the male and female rotors formed by generation from each other in such a manner that the male and female rotors are meshed with each other without any clearance therebetween are defined as reference profiles, each profile of both of the forward and backward flanks of the male and female rotors is formed as a modified profile obtained by angularly shifting the reference profile thereof around a center of the associated rotor by the same angle as each other sufficient to obtain a required minimum gap so as to provide proper backlash between a tooth (teeth) of the rotor and a tooth (teeth) of the other rotor meshed therewith.

Further, in a screw fluid machine such as a screw compressor comprising a female rotor having a main portion positioned inside of a pitch circle thereof and including a plurality of recesses and projections formed between these recesses, with each of the rcesses having a forward flank and a backward flank, and a male rotor having a main portion positioned outside of a pitch circle thereof and including a plurality of projections and recesses formed between these projections and a contour having a backward flank and a forward flank engaged byy the female rotor, with the female and male rotors being rotatably supported in a casing, and the male rotor being driven by a driving means, a method for providing the rotors according to the present invention includes the steps of: calculating coordinates for the reference profiles of the female and male rotors; then machining the rotors to obtain such reference profiles; then calculating coordinates for a modified profile obtained by appropriately angularly shifting or rotating the reference profile of at least one of the forward and backward flanks around a center of the associated rotor; and then further machining the rotor along the calculated modified profile to provide proper backlash between a tooth (teeth) of the rotor and a tooth (teeth) of the other rotor meshed therewith.

Alternatively, the method for providing the rotors in accordance with the present invention may include the steps of: calculating coordinates for the reference profiles of the female and male rotors; then calculating coordinates for a modified profile obtained by appropriately angularly rotating the reference profile of at least one of the forward and backward flanks of the reference profiles around a center of the associated rotor; and then machining the rotors to obtain the calculated reference profiles and the calculated modified profile so as to provide proper backlash between a tooth of one of the rotors and a tooth of the other rotor meshed therewith.

DESCRIPTION OF THE PREFERRED EMBODIMENTS

For better understanding of the present invention, for illustrative purposes only, an oil-cooled screw compressor embodying the present invention will be explained. However, it should be noted that the present invention is not limited to such oil-cooled screw compressor.

Figure 4:
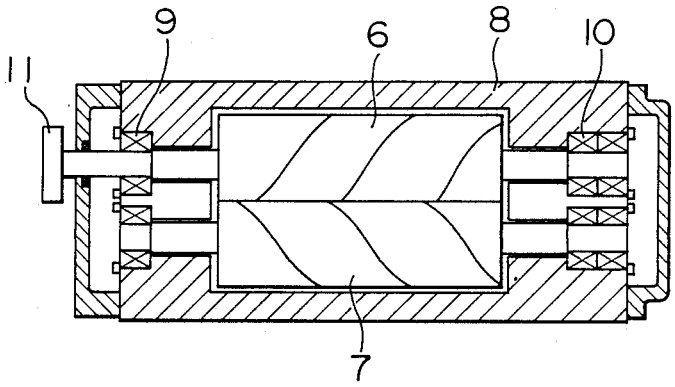
FIG. 4 is a longitudinal sectional view of the screw fluid machine embodied as an oil cooled screw compressor, according to the present invention.

Generally, as shown in FIG. 4, the oil-cooled screw compressor includes a pair of male and female rotors 6 and 7 meshed with each other and arranged in a casing 8 of the compressor, with the rotors 6, 7 being rotatably supported at respective ends by appropriate bearings 9 and 10.

A rotational force is transmitted to the male rotor (driving rotor) 6 through a pulley 11 or the like from an appropriate driving means (not shown), thus rotating the male rotor 6 and then rotating the female rotor (driven rotor) 7 through the engagement therebetween. Further, in operation, oil is supplied to the engaged portions of the rotors 6, 7 through an oil supply passage (not shown), thereby cooling and sealing the compressed air in the compressor. The compressed air under pressure is fed together with the oil from a space created by the engagement of the rotors 6, 7 (compression space) to a tank or the like (not shown) positioned outside of the compressor.

Figure 5A:
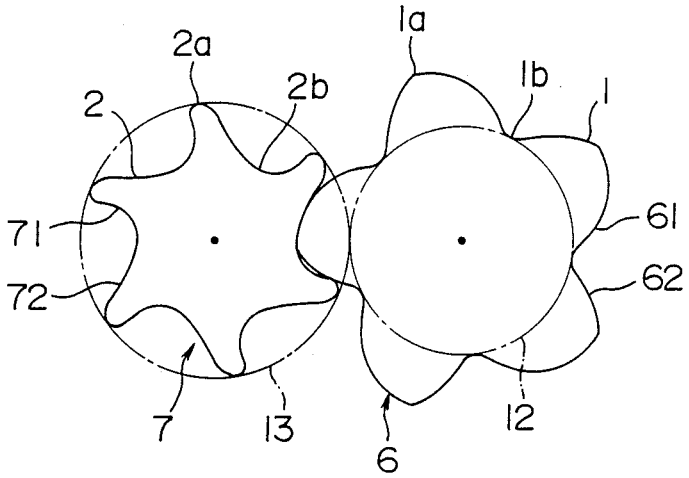
FIG. 5*a* is a side view, on an enlarged scale, of the female and male rotors used in the compressor of FIG. 4.

In FIG. 5*a*, flanks 72 and 71 of the female rotor 7, and flanks 61 and 62 of the male rotor 6 are referred to as "forward flank" and "backward flank" or vice versa, respectively, according to direction of rotation of the rotors. For example, in FIG. 5*b* where the driving male rotor 6 rotates in a clockwise direction, a flank 81 of a tooth of the male rotor 6, positioned forwardly of the tooth with respect to the direction of rotation of the male rotor 6, becomes the forward flank, and a flank 82 which is positioned rearwardly of the tooth with respect to the direction of rotation of the male rotor 6 becomes the backward flank. In a similar manner, a flank 92 of a space of the female rotor 7, positioned forwardly of the space (i.e., rearwardly of the associated tooth) with respect to the direction of rotation of the female rotor 7, becomes the forward flank, and a flank 91 which is positioned rearwardly of the space (i.e., forwardly of said tooth) with respect to the direction of rotation of the female rotor 7 becomes the backward flank. Inversely, in case of FIG. 5*c* where the male or driving rotor 6 is rotated in a counter-clockwise direction, the flank 81 of the male rotor 6 becomes the backward flank and the flank 82 becomes the forward flank, and the flank 92 of the female rotor 7 becomes the backward flank and the flank 91 becomes the forward flank.

As shown in FIG. 5*a*, the male rotor 6 includes a reference profile 1, with each tooth having a tip 1*a* and a bottom 1*b*. The female rotor 7 includes a tip 2*a* of a tooth (top of a space) and a bottom 2*b* of the tooth or the space of the female rotor 7, with the male rotor 6 having a pitch circle 12, and the female rotor 7 having a pitch circle 13. A side surface of the tooth between the tip and the bottom thereof is called as a "flank".

Figure 5B:
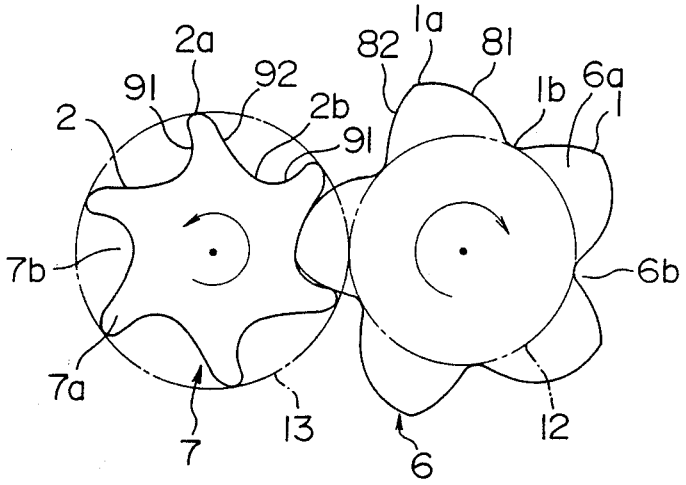
FIG. 5*b* is a side view, on an enlarged scale, similar to FIG. 5*a*, but showing the case where the driving male rotor rotates in a clockwise direction.

As shown in FIG. 5*b*, a main portion of the female rotor 7 is positioned inside of the pitch circle 13 thereof, and the female rotor 7 includes a plurality of recesses (spaces) 7*b* and a plurality of projections (teeth) 7*a* formed between the adjacent recesses 7*b*. Each recess or space 7*b* includes the forward flank 92 and the backward flank 91 as explained above (when the driving rotor 6 is rotated in a clockwise direction).

Figure 5C:
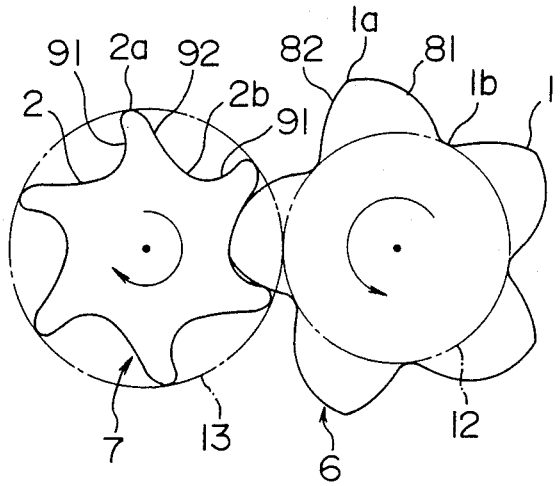
FIG. 5*c* is a side view, on an enlarged scale, similar to FIG. 5*a*, but showing the case where the male rotor rotates in an counter-clockwise direction.

On the other hand, a main portion of the male rotor 6 is positioned outside of the pitch circle 12 thereof, and the male rotor 6 includes a plurality of projections (teeth) 6*a* and a plurality of recesses (spaces) 6*b* formed between the adjacent projections. Each of the projections or teeth 6*a* of the male rotor 6 has a profile engageable with the female rotor 7 and including the forward flank 81 and the backward flank 82 as explained above. In FIG. 5*c*, the direction of rotation of each of the rotors 6, 7 is reversed; thus, the flanks 92 and 81 becomes the backward flanks, whereas, the flanks 91 and 82 become the forward flanks.

As shown in FIG. 4, the driving male rotor 6 imparts the rotation of the female rotor 7 (driven rotor) 7 through the engagement therebetween; however, it is not always true that the forward flank of one of the rotors engages or contacts with the forward flank of the other rotor. In some cases, in an unloading condition for example, the female rotor 7 may act as if it is a driving rotor due to reverse torque generated so that the rotors are rotated through the engagement between the backward flanks of these rotors.

Figure 1:
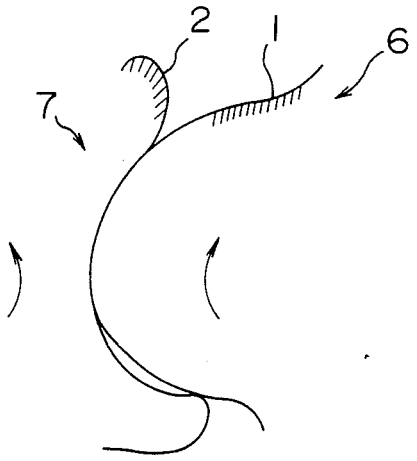
FIG. 1 is a schematic view, on an enlarged scale, of a engagement between female and male rotors each having a reference profile used in a screw fluid machine according to the present invention.

The reference profile 1 of the male rotor 6 and the reference profile 2 of the female rotor 7 shown in FIG. 1 provide tooth shapes, formed by generation from each other, which are engaged by each other through a substantially entire length thereof without gap or clearance therebetween.

Figure 2:
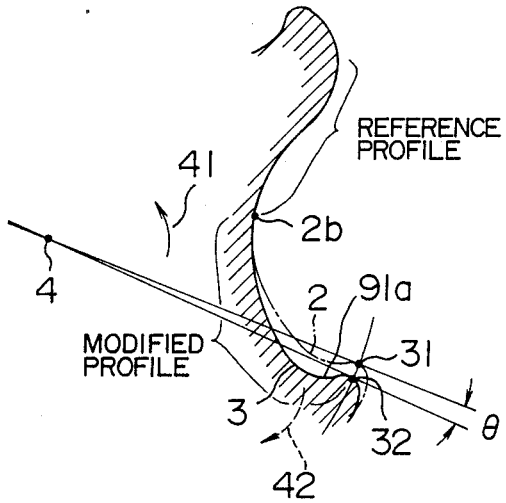
FIG. 2 is a schematic detail view, on an enlarged scale of a portion of the female rotor used in the machine of FIG. 1 for explaining a rotor providing method according to a preferred embodiment of the present invention.
Figure 3:
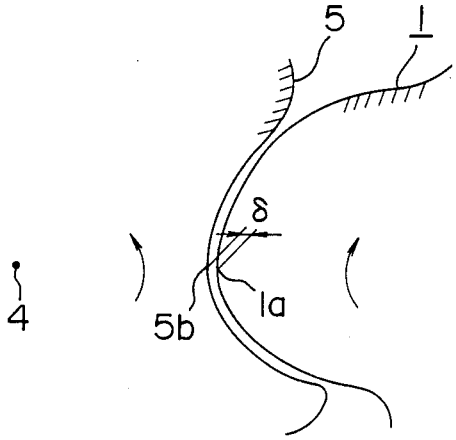
FIG. 3 PRIOR ART
FIG. 3 is a schematic view, on an enlarged scale, of the engagement between female and male rotors of a conventional rotor providing method.

In FIG. 2, it is assumed that the male rotor 6 (not shown in FIG. 2) has the reference profile the same as that shown in FIG. 1. Further, in FIG. 2, the reference profile 2 for the female rotor 7 is shown by a dot chain line and the modified profile 3 obtained by slightly modifying or machining the reference profile 2 to provide a proper gap between the rotors is shown by a solid line, with the point 2*b* corresponding to a boundary point between the forward and backward flanks. In order to obtain the modified profile 3 of the present invention for the female rotor 7, the flank has a contour created by angularly shifting or rotationally displacing the reference profile 2 of the female rotor 7 around a center 4 of the female rotor 7 in a direction (shown by a broken line arrow 42) opposite to the direction (shown by an arrow 41) of rotation of the female rotor 7 by an angle $\theta$ from a tip point 31 to a tip point 32.

Here, such angular shifting of the reference profile from the point 31 to the point 32 means that the reference profile of the female rotor 7 is angularly shifted or rotated by such an amount so as to provide proper backlash between the engaged portions of the female rotor 7 and the male rotor 6.

In other words, the modified profile is obtained by angularly shifting the reference profile of one of the female rotor 7 and the male rotor 6 to be engaged with each other by such an amount as to provide a proper or appropriate backlash with respect to the flank of the other rotor to be engaged by said one of the rotor.

Further, the proper or appropriate backlash means a minimum gap to be previously formed to absorb an estimated total dimensional error derived from a machining error, thermal expansion of the rotors generated during the operation of the compressor, an error of center distance between the rotors and the like.

Figure 6:
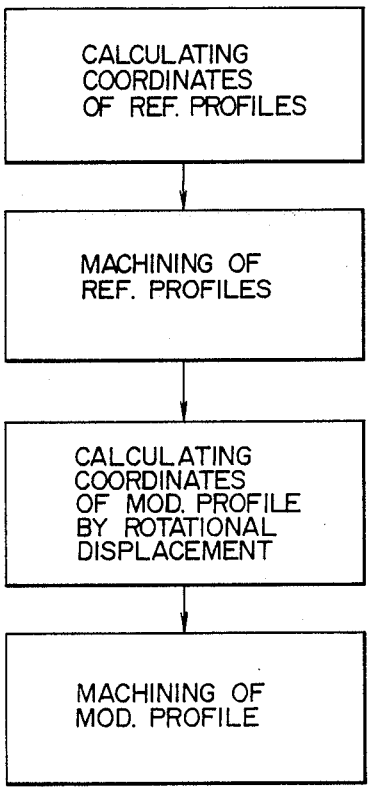
FIG. 6 is a flow chart of the steps of the rotor providing method according to one embodiment of the present invention.

FIG. 6 shows the method wherein after the reference profile is obtained the modified profile is machined, comprising the steps of:

(a) calculating coordinates for the reference profiles of the female and male rotors;
(b) then machining the rotors to obtain the calculated reference profiles;
(c) then calculating coordinates for a modified profile obtained by appropriately angularly shifting or rotationally displacing the reference profile of at least one of the forward and backward flanks around a center of the associated rotor; and
(d) then further machining the rotor to obtain the calculated modified profile, thereby providing proper backlash between a tooth (or teeth) of the rotor and a tooth (or teeth) of the other rotor meshed therewith.

Figure 7:
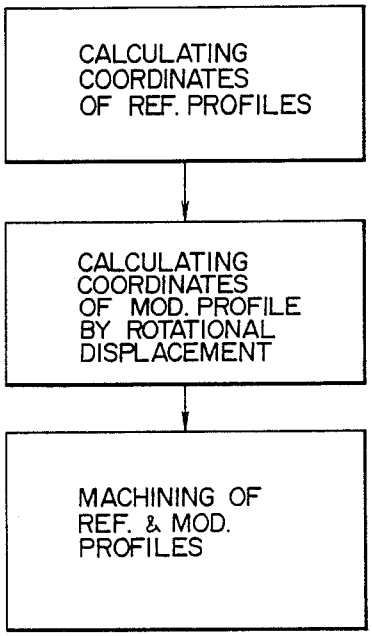
FIG. 7 is a flow chart showing the steps of the rotor providing method according to another embodiment of the present invention.

FIG. 7 shows the method wherein the reference profiles and the modified profile are formed by machining at once, comprising the steps of:

(a) calculating coordinates for the reference profiles of the female and male rotors;
(b) then calculating coordinates for a modified profile obtained by appropriately angularly shifting or rotationally displacing the reference profile of at least one of the forward and backward flanks around a center of the associated rotor; and
(c) then machining the rotors to obtain the calculated reference profiles and the calculated modified profile, thereby providing proper backlash between a tooth (teeth) of one of the rotors and a tooth (teeth) of the other rotor meshed therewith.

With such construction, since there is always a backlash between the female rotor 7 and the male rotor 6 meshed with each other, it is possible to always contact the rotors along the contact track of the reference profile, thus providing uniform or constant rotational motions of the rotors, with the result that the performance or efficiency of the oil-cooled screw compressor is increased and the noise and/or vibration can be reduced.

In the embodiment mentioned above, while an example, where the modified profile 3 of the female rotor 7 is obtained by slightly angularly shifting the reference profile 2 of the female rotor 7 in a direction opposite to that of rotation of the female rotor 7 as shown in FIG. 2, has been explained, the present invention is not limited to such formation of the modified profile. The same effect or advantage obtained by the above-described embodiments may be realized even when a modified profile for the male rotor 6 is obtained by angularly shifting only the reference profile of the backward flank of the male rotor 6 by an amount sufficient to provide for a backlash only between the backward flanks of the female rotor 7 and the male rotor 6.

Further, either one of the forward and backward flanks in each of the female rotor 7 and the male rotor 6 may be formed as the modified profile explained above; or all portions of the flanks other than the tip and the bottom may be formed as the modified profile explained above. In the latter case, it is possible to obtain the modified profile by angularly shifting the reference profile of each of the forward and backward flanks by the same angle as each other sufficient to provide a minimum gap required for providing proper backlash between the rotors.

Figure 8:
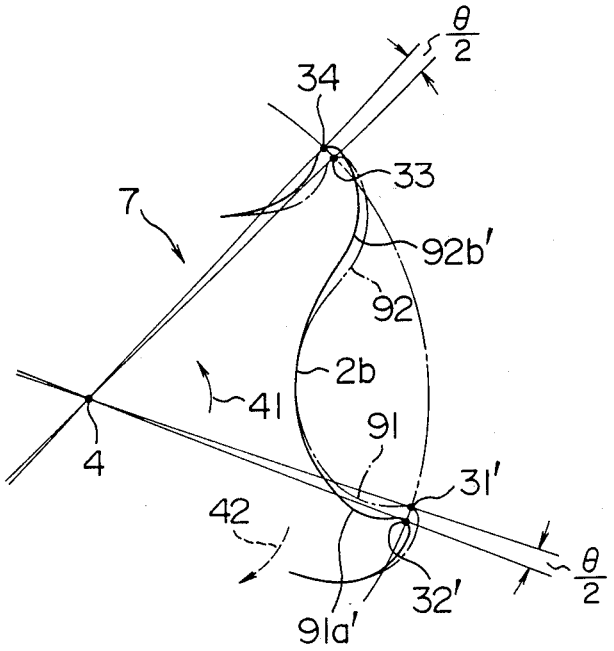
FIG. 8 is a schematic detail view, on an enlarged scale, of a portion of the female rotor for explaining a rotor providing method according to further embodiment of the present invention.

To form both the forward and backward flanks of the female rotor 7 as modified profiles, as shown in FIG. 8, assuming that the female rotor 7 is rotated in a direction shown by the arrow 41, a modified profile 92*b*′ is obtained by angularly shifting or rotationally displacing the forward flank (having the reference profile) 92 by an angle $\theta/2$ from a tip point 33 to a tip point 34 in the direction shown by the arrow 41, and at the same time, a modified profile 91*a*′ is obtained by angularly shifting or rotationally displacing the backward flank (having the reference profile) 91 by an angle $\theta/2$ from a tip point 31′ to a tip point 32′ in an opposite direction shown by the broken line arrow 42. In this way, by angularly shifting both of the forward and backward flanks by a half of the angle $\theta$, respectively, the minimum required gap can be obtained.

Figure 9:
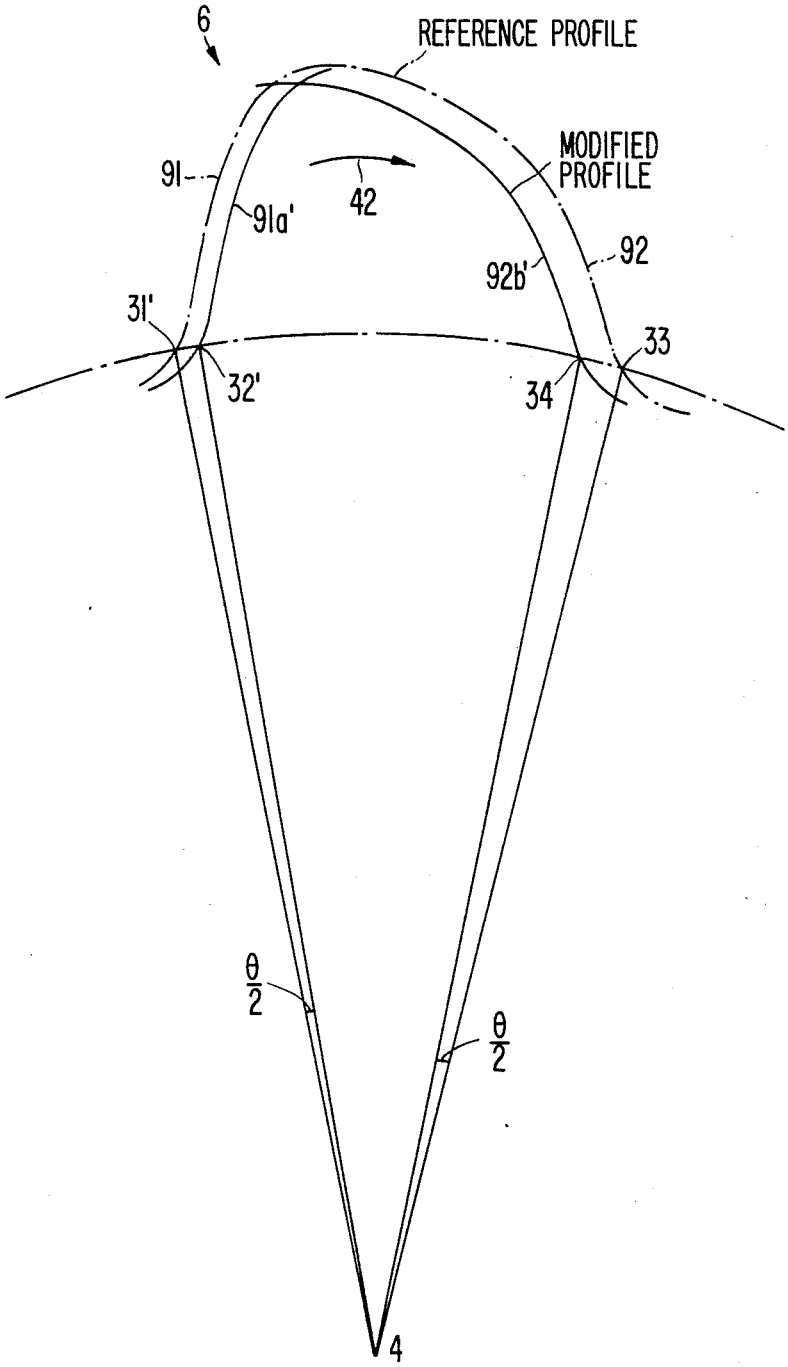
FIG. 9 is a schematic detailed view, on an enlarged scale, of yet a further embodiment of the present invention.

As shown in FIG. 9, assuming the female rotor is rotating in a direction of the arrow 42, a modified profile 92b' is obtained by angularly shifting or rotationally displacing the forward flank 92 by an angle $\theta/2$ from a tip point 33 in a direction opposite the direction of the arrow 42 and, at the same time, a modified profile 91a' is obtained by angularly shifting or rotationally displacing the rearward flank 91 by an angle $\theta/2$ from a tip point 31' to tip point 32' in the direction of the arrow 42. In this manner, by angularly shifting both the forward and backward flanks 92, 91, by half of the angle $\theta$, respectively, the minimum required gap can be obtained.

It is apparent that the forward and backward flanks of only the male rotor 6 can be formed as the modified profile by adopting the above-mentioned techniques. Further, it should be understood that both of the female rotor 7 and the male rotor 6 may have the modified profiles, respectivey. In this case, each of the modified profiles can be obtained by angularly shifting or rotationally displacing the corresponding reference profile by an angle $\theta/4$.

Lastly, while the present invention has been explained in connection with the profiles of the rotors used in the oil-cooled screw compressor, it should be noted that the present invention can be applied to any other screw fluid machines within the scope expected to achieve the same effect as that in the illustrated embodiments.

As stated above, according to the present invention, it is possible to provide a screw fluid machine wherein only a necessary gap (backlash) is provided between the female rotor 7 and the male rotor 6 meshed with each other, thus enabling the uniform or constant rotational movements of the rotors at all times, increasing the efficiency or performance of the machine and reducing the noise and/or vibration.

What is claimed is:

1. A screw fluid machine comprising a female rotor including a main portion positioned inside a pitch circle thereof and a plurality of recesses and a plurality of projections formed between said recesses, each of said recesses having a forward flank and a backward flank, and a male rotor including a main portion positioned outside a pitch circle thereof, a plurality of projections and a plurality of recesses formed between said projections of the male rotor, and a contour having a backward flank and a forward flank each engageable by said female rotor, said female and male rotors being rotatably supported in a casing of said screw fluid machine, and said male rotor being driven by a driving means, wherein when tooth shapes of said female and male rotors formed in such a manner that said female and male rotors are meshed with each other without clearance therebetween are defined as reference profiles, a profile of at least one of said forward and backward flanks of said female and male rotors is formed as a modified profile obtained by appropriately angularly shifting said reference profile of the associated flank around a center of the associated rotor so as to provide proper backlash between a tooth including said profile and a tooth of the other rotor meshed therewith.

2. A screw fluid machine comprising a female rotor including a main portion positioned inside a pitch circle thereof and a plurality of recesses and a plurality of projections formed between said recesses, each of said recesses having a forward flank and a backward flank, and a male rotor including a male portion positioned outside a pitch circle thereof, a plurality of projections and a plurality of recesses formed between said projections of the male rotor, and a contour having a backward flank and a forward flank each engageable by said female rotor, said female and male rotors being rotatably supported in a casing of said screw fluid machine, and said male rotor being driven by a driving means, wherein when tooth shapes of said female and male rotors formed in such a manner that said female and male rotors are meshed with each other without clearance therebetween are defined as reference profiles, both profile of said forward and backward flanks of said female and male rotors are formed, respectively, as modified profiles obtained by angularly shifting the reference profiles of said both profiles around a center of the associated rotor by the same angle as each other sufficient to obtain a required minimum gap so as to provide proper backlash between a tooth including said both profiles and a tooth of the other rotor meshed therewith.

3. In a screw fluid machine comprising a female rotor, a main portion of which is positioned inside of a pitch circle thereof and which includes a plurality of recesses and a plurality of projections formed between said recesses, each of said recesses having a forward flank and a backward flank, and a male rotor, a main portion of which is positioned outside of a pitch circle thereof and which includes a plurality of projections and a plurality of recesses formed between said projections of the male rotor and further includes a contour having a backward flank and a forward flank each engageable by said female rotor, said female and male rotors being rotatably supported in a casing of said machine, and said male rotor being driven by a driving means, a method for providing said rotors comprises the steps of:

calculating coordinates for reference profiles of said female and male rotors;

then machining said rotors to obtain the calculated reference profiles;

then calculating coordinates for a modified profile obtained by appropriately angularly shifting the reference profile of at least one of said forward and backward flanks around a center of the associated rotor; and then further machining said associated rotor to obtain the calculated modified profile, thereby providing proper backlash between a tooth of said associated rotor and a tooth of the other rotor meshed therewith.

4. In a screw fluid machine comprising a female rotor, a main portion of which is positioned inside of a pitch circle thereof and which includes a plurality of recesses and a plurality of projections formed between said recesses, each of said recesses having a forward flank and a backward flank, and a male rotor, a main portion of which is positioned outside of a pitch circle thereof and which includes a plurality of projections and a plurality of recesses formed between said projections of the male rotor and further includes a contour having a backward flank and a forward flank each engageable by said female rotor, said female and male rotors being rotatably supported in a casing of said machine, and said male rotor being driven by a driving means, a method for providing said rotors comprises the steps of:

calculating coordinates for reference profiles of said female and male rotors;

then calculating coordinates for a modified profile obtained by appropriately angularly shifting the reference profile of at least one of said forward and backward flanks around a center of the associated rotor; and then machining said rotors to obtain the calculated reference profiles and the calculated modified profile, thereby providing proper backlash between teeth of said rotors meshed with each other.

* * * * *